US008944712B2

(12) United States Patent
Thorpe

(10) Patent No.: US 8,944,712 B2
(45) Date of Patent: Feb. 3, 2015

(54) COSMETIC BOTTLE WITH AUTOMATIC EXTENDING APPLICATOR

(75) Inventor: James Thorpe, London (GB)

(73) Assignee: HCT Asia Ltd, Central (HK)

( * ) Notice: Subject to any disclaimer, the term of this patent is extended or adjusted under 35 U.S.C. 154(b) by 768 days.

(21) Appl. No.: 12/723,495

(22) Filed: Mar. 12, 2010

(65) Prior Publication Data

US 2011/0222955 A1 Sep. 15, 2011

(51) Int. Cl.
*A46B 11/00* (2006.01)
*A46B 9/02* (2006.01)
*A45D 34/04* (2006.01)

(52) U.S. Cl.
CPC ..... *A46B 9/021* (2013.01); *A45D 34/045* (2013.01); *A46B 11/00* (2013.01)
USPC ..... 401/127; 132/218

(58) Field of Classification Search
CPC ..... A45D 34/045; A46B 11/00; A46B 9/021
USPC ..... 401/126, 127, 128, 129; 132/216, 218
See application file for complete search history.

(56) References Cited

U.S. PATENT DOCUMENTS 3,337,901 A * 8/1967 Schefer et al. ..... 401/129
5,116,154 A * 5/1992 Fulkerson ..... 401/127
5,690,441 A * 11/1997 McManus ..... 401/127
6,062,757 A * 5/2000 Gueret ..... 401/122
6,164,857 A * 12/2000 Wolfarth-Brooks et al. . 401/127
6,290,416 B1 * 9/2001 Gueret ..... 401/122
6,789,970 B1 * 9/2004 Shearon et al. ..... 401/127
6,872,020 B2 * 3/2005 Epli ..... 401/127
7,398,898 B2 * 7/2008 Bouix et al. ..... 222/183
7,429,141 B2 * 9/2008 Habatjou ..... 401/127
7,614,404 B2 * 11/2009 Kee ..... 132/218
8,074,665 B2 * 12/2011 Pires et al. ..... 132/293

OTHER PUBLICATIONS

Sephora, Urban Decay Cosmetics, retrieved on Mar. 11, 2010 at <<http://www.sephora.com/browse/product.jhtml?id=P204729&cm_mmc=us_search-__-GoogleBase-__-P204729-__-1051143&__requestid=42976&ci__src=14110944&ci__sku=1051143>>, 5 pages.

* cited by examiner

*Primary Examiner* — David Walczak
*Assistant Examiner* — Jennifer C Chiang
(74) *Attorney, Agent, or Firm* — Lee & Hayes, PLLC

(57) ABSTRACT

An applicator includes a bottle cap with an automatically extending applicator head coupled to a spring. The bottle cap is removably coupled to a bottle having a reservoir for containing a product, such as a cosmetics product or a medicinal product. By virtue of having an automatic extending applicator head, the applicator is capable of extending during application and retracting during storage in a clean and automatic fashion.

20 Claims, 6 Drawing Sheets

COSMETIC BOTTLE WITH AUTOMATIC EXTENDING APPLICATOR

BACKGROUND

Devices exist for applying cosmetic or medicinal products. Such devices usually consist of an outer tubular shell or bottle for holding a product, a cap for closing the bottle and containing the product, and an applicator tip. For example, in the medical industry, applicators are employed for applying medicinal products, such as ointments, to portions of the body. In the cosmetics and personal care industries, applicators are used to apply lipstick, lip balm, skin creams, lotions, powders, and other cosmetic products to portions of the body.

In addition, various personal care implements, such as, for example, foundation and lip-gloss applicators exist. These implements may be usable with one or more personal care products, such as rouge, powder, lip-gloss, or the like. These implements typically consist of a handle with a stem that protrudes an applicator tip into a bottle of product.

Existing cosmetic and medicinal applicators and personal care implements have limited utility, in that each applicator stem is too short for practical use and/or allows too much product to reach the stem. Thus, consumers typically need to buy large applicators and implements for their medical, cosmetic, and grooming needs or they must regularly clean-up messy applicator stems or product spills. Accordingly, there remains a need in the art for improved applicators and implements.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

This application describes applicators and implements comprising automatically extending applicator heads. Applicator heads may automatically extend from bottle caps. By virtue of having automatic extending applicator heads, such applicators and implements may be compact and portable yet long enough for easy application of various different cosmetic, medicinal, and/or personal care products.

Generally, an applicator according to this disclosure comprises a bottle with a reservoir for containing a product to be applied, a removable bottle cap with a movable applicator head, and a spring for automatically extending the applicator head from within the bottle cap. In various embodiments, implements may or may not include a threaded rotational retention mechanism for coupling the bottle to the bottle cap.

The bottle cap may be removably coupled to the bottle by a variety of attachment means, such as by a threaded rotational retention mechanism, by a push-and-twist lock mechanism such as a bayonet retention mechanism, by magnetic force, by interference fit, or by combinations of any of the foregoing, or the like.

Illustrative Applicator with Automatic Extending Applicator Head (Opened)

Figure 1:
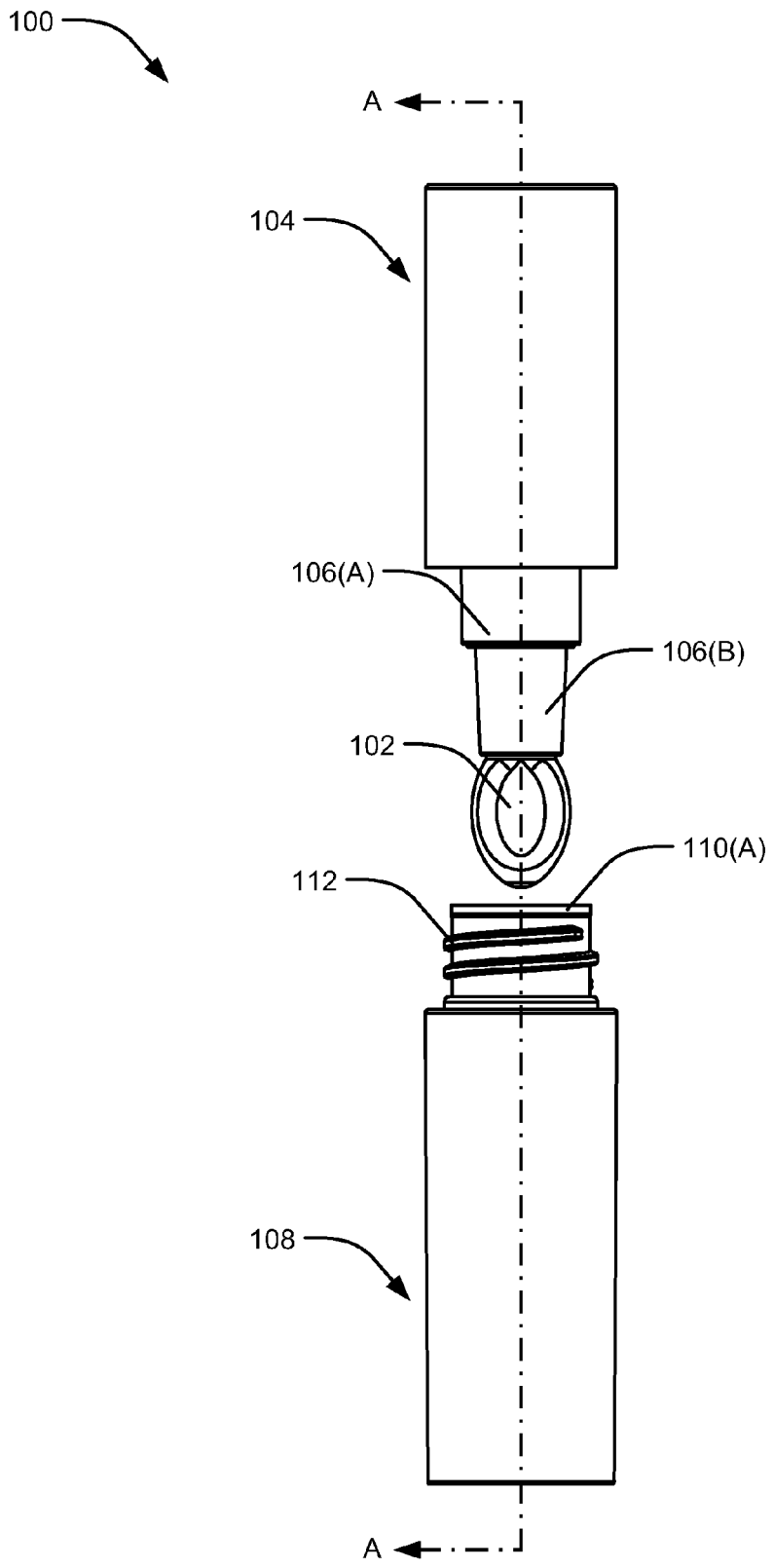
FIG. 1 depicts an illustrative applicator in an open position with an automatic extending applicator removably coupled to a bottle.

FIG. 1 depicts an illustrative applicator 100 in an open position with an applicator head 102 which automatically extends from a bottle cap 104. The bottle cap 104 includes a stem 106, made up of an inner stem (not shown), a middle stem 106(A), and an outer stem 106(B), coupled to a spring (not shown) inside the bottle cap 104. The bottle cap 104 may be removably coupled to a bottle 108. The bottle 108 includes a reservoir (not shown) for containing a cosmetic, medicinal, personal care, or other product. In the illustrated embodiment, the bottle 108 also includes a wiper 110 and a threaded rotational retention mechanism 112, such as a screw cap.

The applicator head 102 may comprise a dovetail sponge applicator, as seen in FIG. 1, a cylindrical sponge applicator head (not shown), or any other type of applicator head for application of the product to the body. By way of example and not limitation, in the embodiment shown in FIG. 1, the applicator head 102 comprises a soft dovetail sponge for application of a product such as foundation, blush, or other loose powder cosmetic products.

As shown in FIG. 1, the applicator 100 is in the open position, with the stem 106 and applicator head 102 fully extended. Automatic extension of the stem 106 and applicator head 102 may be facilitated by a spring (not shown) internally coupled between the stem 106 and the bottle cap 104. Also not shown in FIG. 1, a threaded rotational retention mechanism complimentary to threaded rotational retention mechanism 112 may reside within the collar of bottle cap 104 from where the stem 106 extends.

The wiper 110, comprising outer wiper 110(A) and inner wiper (not shown) is compatible with the stem 106 such that when the applicator 100 is closed, only a predetermined amount of the stem 106 and applicator head 102 may enter the bottle 108. Additionally, the stem 106 is designed to keep the product contained within the bottle 108 when the applicator 100 is closed.

Figure 2:
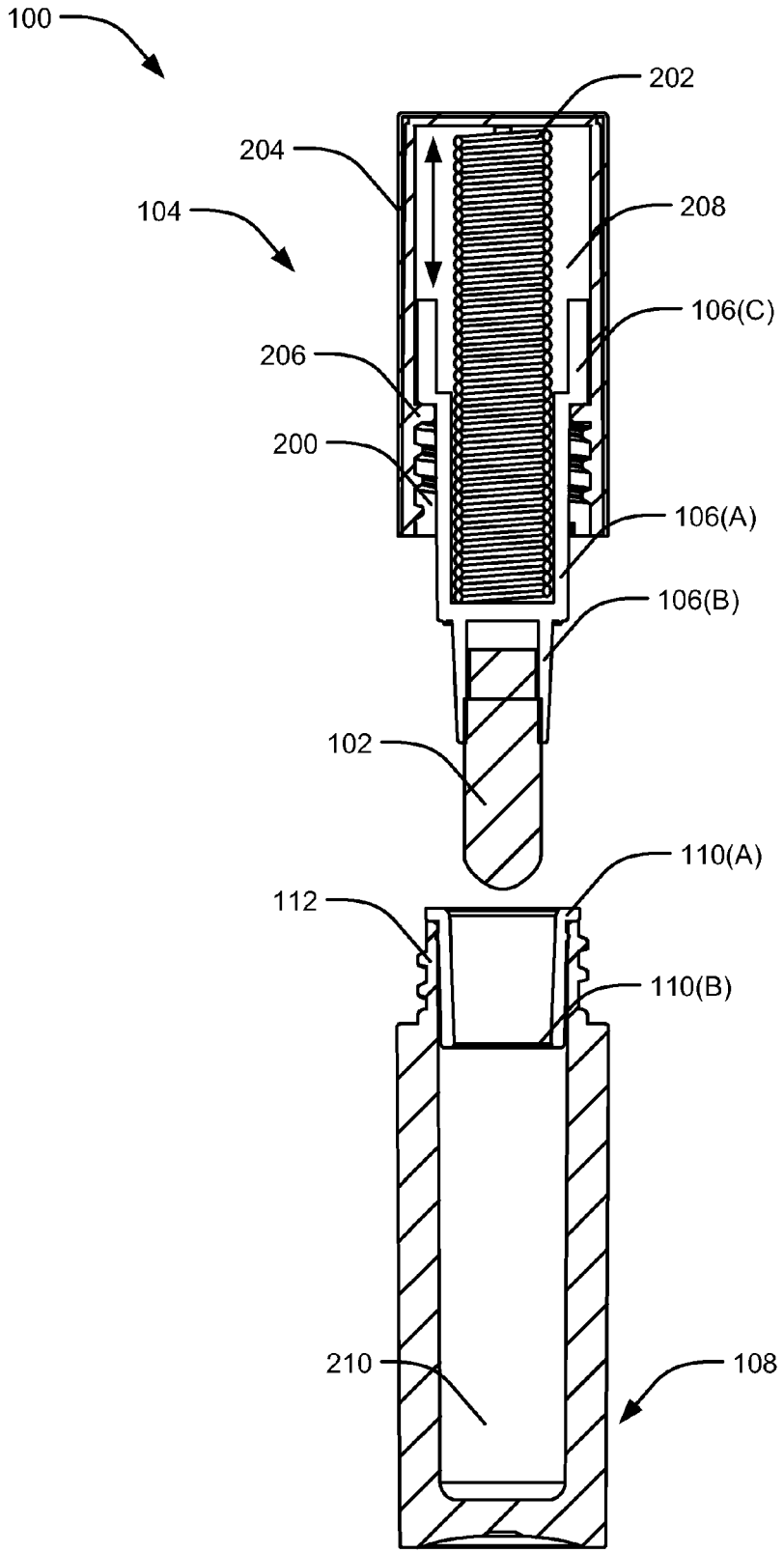
FIG. 2 is a cross-sectional view of the applicator shown in FIG. 1, taken along line A-A of FIG. 1.

FIG. 2 depicts a cross-section of the applicator 100, taken along line A-A in FIG. 1. As shown in FIG. 2, the threaded rotational retention mechanism 112 of the bottle 108 and the complimentary threaded rotational mechanism 200 of the bottle cap 104 each include one or more threads configured to engage, and removably couple, the bottle 108 and the bottle cap 104.

As discussed above, in the open position the stem 106, comprising middle stem 106(A), outer stem 106(B), and inner stem 106(C), and the applicator head 102 are fully extended. In the embodiment shown in FIG. 2, the stem 106 and the applicator head 102 are automatically extended by way of spring 202. Spring 202 is configured to supply enough force to automatically extend stem 106 and applicator head 102 a predetermined distance out of bottle cap 104.

Figure 3:
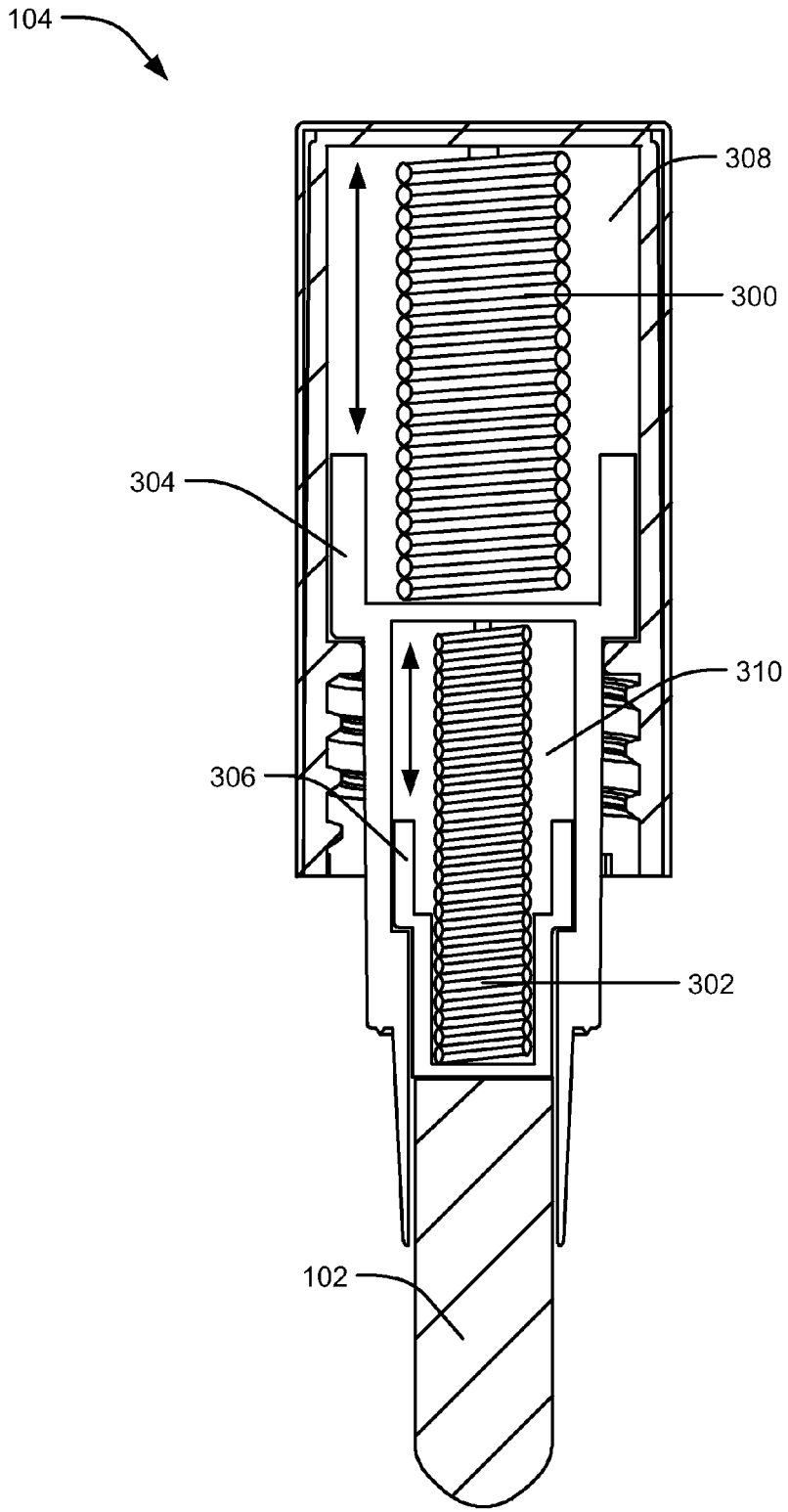
FIG. 3 depicts an illustrative applicator cap in an open position with a two-stage automatic extending applicator similar to that in FIG. 2.

While the spring 202 of FIG. 2 is shown as a coil spring, other types of springs could be used. Additionally, opposed magnets that repel each other or elastomeric foam could be used to the supply the force for automatically extending the stem 106 and the applicator head 102. Additionally, while only one level of extension is show, the applicator 100 could use a two stage extension system to achieve additional length during use (as shown in FIG. 3).

As shown in FIG. 2, bottle cap 104 comprises outer bottle cap 204, inner bottle cap 206, and bottle cap channel 208. Outer bottle cap 204 may be metal or plastic and may be designed for manual gripping. When extended, as in FIG. 2, lower stem 106(C) may restrict the automatic extension from going beyond the inner bottle cap 206. For example, stem 106 may extend and retract longitudinally within bottle cap channel 208; however, lower stem 106(C) may prevent the stem 106 from extending beyond the bottle cap channel 208 by being compatibly designed to come into contact with the outer portion of the inner bottle cap 206 (i.e., the position shown in FIG. 5).

Bottle 108 may also include a product reservoir 210 for holding a cosmetic, medicinal, personal care, or other product, and a wiper 110. Wiper 110 may comprise outer wiper 110(A) and inner wiper 110(B). Outer wiper 110(A) may be designed for keeping product from escaping the reservoir while applicator 100 is open or closed. Additionally, outer wiper 110(A) may also be for wiping excess product from the applicator head 102 prior to application. Outer wiper 110(A) may also be compatibly designed to come into contact with middle stem 106(A) while bottle cap 104 is connected to bottle 108. Inner wiper 110(B) may be compatibly designed for keeping product from coming in contact with more than the tip of applicator head 102. Keeping the product from contacting the entire applicator head 102 may help with cleanliness of the applicator 100 and overall user satisfaction.

In the embodiment shown in FIG. 2, the viewing angle is 90° of that shown in FIG. 1. Therefore, the dovetail sponge seen in FIG. 1 appears to be of a different shape in FIG. 2. However, this appearance is merely caused by the changed viewing angle and the inherent shape of a dovetail sponge, that is, asymmetrically bulbous and flattened. Additionally, any type of retention mechanism may be used to removably couple the bottle cap 104 and the bottle 108. For example, a push-and-twist lock such as a bayonet retention mechanism, a magnetic force retention mechanism, an interference fit retention mechanism, or combinations of any of the foregoing, or the like, may be used to removably couple the bottle cap 104 and the bottle 108.

FIG. 3 depicts an alternative embodiment of bottle cap 104 with a two stage extension system. In this embodiment, the bottle cap 104 may use an inner spring 300 and an outer spring 302. The inner spring 300 may apply a force to a primary stem 304 and the outer spring 302 may apply a force to a secondary stem 306. While the primary stem 304 may extend and retract longitudinally within a primary bottle cap channel 308, the secondary stem 306 may extend and retract longitudinally within a secondary bottle cap channel 310. Additionally, in this embodiment, secondary stem 306 may be coupled to applicator head 102. Thus, when the bottle cap 104 is open, the inner spring 300 forces the full extension of the primary stem 304, and the outer spring 302 forces the full extension of the secondary stem 306 such that the applicator head 102 is automatically extended a predetermined distance out of the bottle cap 104.

As discussed above with reference to FIG. 2, while coil springs are shown in this embodiment, other types of springs may be used here, in the two stage extension system, as well. Additionally, other types of automatic extension mechanisms may be used also. For example, opposed magnets that repel each other or elastomeric foam could be used to automatically extend the applicator head 102 from the bottle cap 104 when the bottle cap 104 is open.

Illustrative Applicator with Automatic Extending Applicator Head (Closed)

Figure 4:
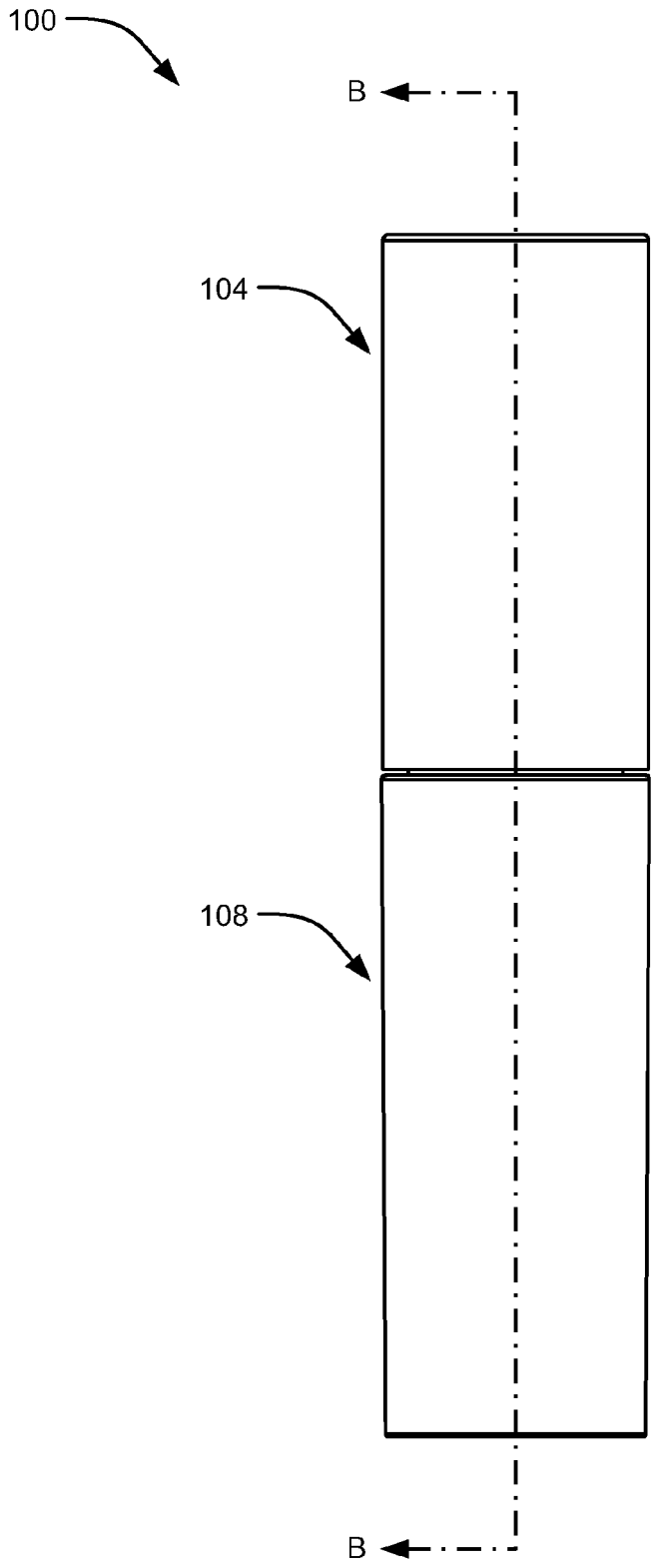
FIG. 4 depicts an illustrative applicator in a closed position with an automatic extending applicator removably coupled to a bottle.

FIG. 4 depicts the applicator 100 in a closed position with the applicator head (not shown) retracted within the bottle cap 104. The bottle cap 104 may be removably coupled to the bottle 108. As shown in FIG. 4, and by way of example only, the bottle cap 104 and the bottle 108 are screwed together with a threaded rotational retention mechanism.

Figure 5:
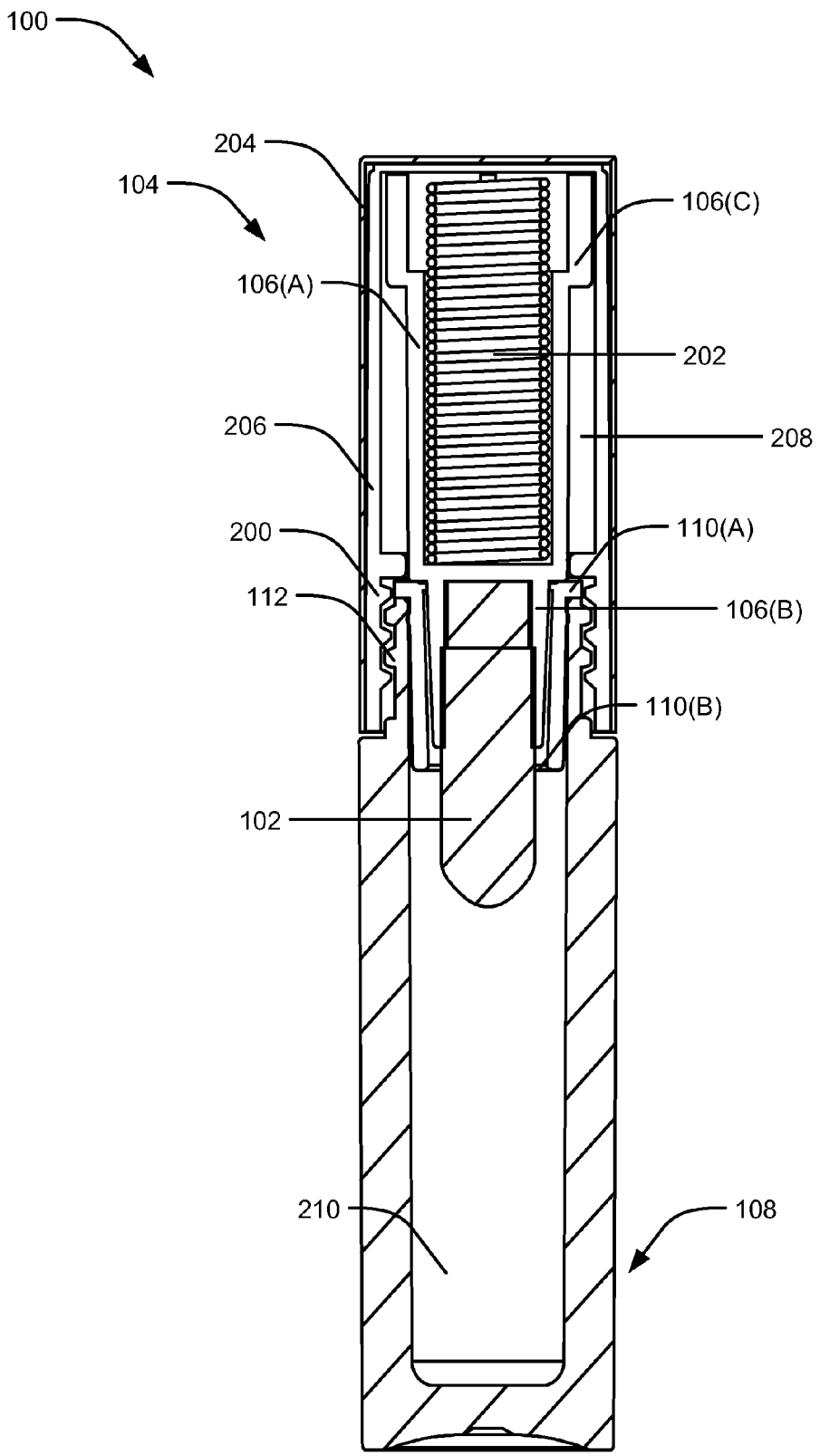
FIG. 5 is a cross-sectional view of the applicator shown in FIG. 4, taken along line B-B of FIG. 4.

FIG. 5 depicts a cross-section of the applicator 100, taken along line B-B in FIG. 4. As shown in FIG. 5, the threaded rotational retention mechanism 112 of the bottle 108 and the complimentary threaded rotational mechanism 200 of the bottle cap 104 each include one or more threads configured to engage, and removably couple, the bottle 108 and the bottle cap 104. In this embodiment, the complimentary threads of threaded rotational retention mechanism 112 and threaded rotational mechanism 200 fit together to removably couple the bottle 108 and the bottle cap 104.

In the closed position both the stem 106, comprising middle stem 106(A), outer stem 106(B), and inner stem 106(C), and the applicator head 102 are fully retracted. In the embodiment shown in FIG. 5, the stem 106 and the applicator head 102 are automatically retracted by way of force applied by outer wiper 110(A) of the bottle 108. As discussed above with reference to FIG. 2, the outer wiper 110(A) may be compatibly designed to come into contact with the middle stem 106(A) while the bottle cap 104 is connected to the bottle 108, thus exerting enough force on the spring 202 to automatically retract the stem 106 and the applicator head 102.

As shown in FIG. 5, and discussed above with reference to FIG. 2, the bottle cap 104 comprises outer bottle cap 204, inner bottle cap 206, and bottle cap channel 208. Again, the outer bottle cap 204 may be metal or plastic and may be designed for manual gripping. When retracted, as in FIG. 5, the inner bottle cap 206 may restrict the automatic retraction of the stem 106 from protruding out of the bottle cap 104. As discussed above, the stem 106 may extend and retract longitudinally within the bottle cap channel 208. Additionally, the spring 202 may be configured to provide only enough force to automatically extend the stem 106 and the applicator head 102 without providing too much force to prohibit the stem 106 and the applicator head 102 from being fully retracted when the applicator 100 is in the closed position.

As discussed above, the bottle 108 may also include a product reservoir 210 for holding a cosmetic, medicinal, personal care, or other product, and the wiper 110. Wiper 110 is configured to comprise outer wiper 110(A) and inner wiper 110(B). Outer wiper 110(A) may be designed for keeping product from escaping the reservoir while the applicator 100 is open or closed. Additionally, the outer wiper 110(A) may also be for wiping excess product from the applicator head 102 prior to application.

Much like that described with reference to FIG. 2, in the embodiment shown in FIG. 5, the viewing angle is 90° of that shown in FIG. 1. Therefore, the dovetail sponge seen in FIG. 1 appears to be of a different shape in FIG. 5. However, this appearance is merely caused by the changed viewing angle and the inherent shape of a dovetail sponge, that is, asymmetrically bulbous yet flattened on one side. Additionally, any type of applicator may be used, such as but not limited to, a brush applicator head, a non-dovetail shaped sponge applicator head, a foam applicator head, or any other type of medicinal or cosmetic applicator head.

As discussed above, with reference to FIGS. 1 and 2, any type of retention mechanism may be used to removably couple the bottle cap 104 and the bottle 108. For example, a push-and-twist lock retention mechanism such as a bayonet retention mechanism, a magnetic force retention mechanism, an interference fit retention mechanism, or combinations of any of the foregoing, or the like, may be used to removably couple the bottle cap 104 and the bottle 108.

Illustrative Applicator with Automatic Extending Applicator Head (Exploded)

Figure 6:
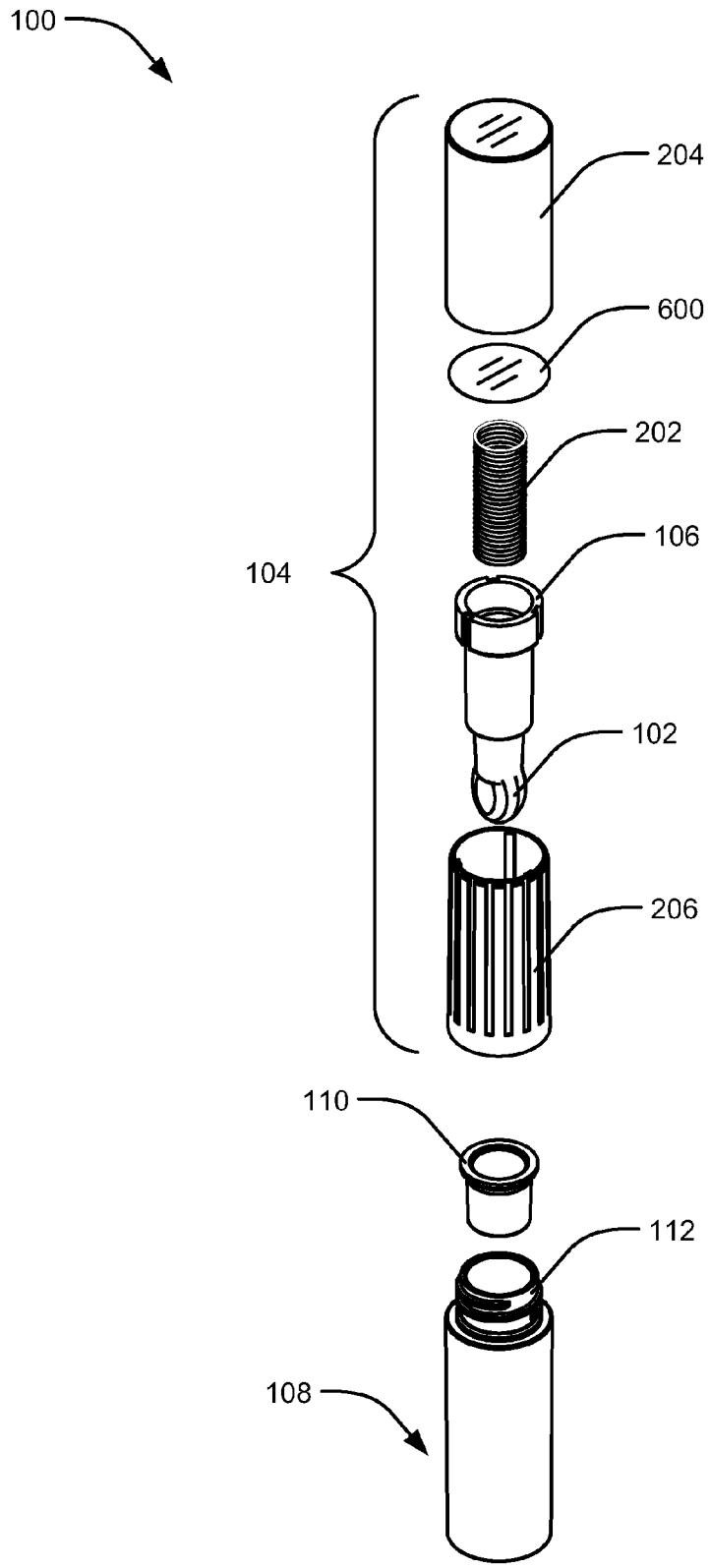
FIG. 6 is an exploded view of the applicator of FIGS. 1, 2, 4, and 5.

FIG. 6 depicts an exploded view of applicators (like applicator 100) or implements according to this disclosure. As noted above, any type of retention mechanism for removably coupling bottle cap 104 and bottle 108 may be used. By way of example and not limitation, applicator 100 is shown in FIGS. 1-6 with a threaded rotational retention mechanism 112 residing at the mouth of the bottle 108 and within the mouth (not shown) of the inner bottle cap 206.

FIG. 6 depicts bottle cap 104 and bottle 108. Bottle 108 includes a product reservoir (not shown), a threaded rotational retention mechanism 112 (as discussed above), and a wiper 110. The bottle cap 104 may include an outer bottle cap 204, a spring 202, a stem 106 coupled to applicator head 102, an inner bottle cap 206, and an aluminum foil circle 600. The aluminum foil circle 600 may be used to aid in the assembly of the bottle cap 104. The aluminum foil circle 600 aids in assembly by preventing the stem 106 and the spring 202 from falling out of the cap 206 while being handled during assembly. In addition, it provides a safety enclosure so that the spring 202 does not exert an upward force on the outer cap 204 that might separate outer cap 204 from inner cap 206 when the container is closed and the applicator is retracted. Thus, the aluminum foil circle 600 may be affixed to the bottom of the stem 106 during assembly after the spring 202 is placed within the stem 106.

As shown in FIG. 6, the stem 106 may be assembled into the inner bottle cap 206 from the top and the spring 202 may be placed inside with the aluminum foil circle 600 placed on the top of the spring 202. Once assembled, the applicator 100 may be used to apply medicinal products or cosmetic products, such as, for example, lipstick, chap stick, lip gloss, lotions, creams, gels, powders, rouges, blushes, foundation, etc.

Unless otherwise indicated above, regarding FIGS. 1-6, various components of the foregoing implementations may be constructed of any suitable material. By way of example and not limitation, suitable materials may include plastics, metals (e.g., aluminum, titanium, steel, nickel, tin, copper, brass, alloys thereof, etc.), ceramics, composites, combinations of the foregoing, or the like. Additionally, the parts comprising applicator 100 may be constructed using an extrusion blow molding process, an injection molding process, or any other type of molding process.

Conclusion

Although embodiments have been described in language specific to structural features and/or methodological acts, it is to be understood that the disclosure is not necessarily limited to the specific features or acts described. Rather, the specific features and acts are disclosed as illustrative forms of implementing the embodiments.

What is claimed is:

1. An applicator comprising:

a bottle comprising a wiper; and a bottle cap removably coupled to the bottle, the bottle cap comprising:

an applicator head movably coupled to the bottle cap via a spring, and a stem having an inner surface, a portion of the inner surface of the stem enclosing and in contact with a portion of an exterior surface of the spring; when the bottle cap is coupled to the bottle, the spring is compressed, a portion of the stem rests on the bottle causing the applicator head to be in contact with the wiper.

2. The applicator of claim 1, the bottle further comprising a product reservoir, the bottle cap further comprising an inner cavity.

3. The applicator of claim 2, the wiper configured to prevent the applicator head from entering the bottle beyond a predetermined depth when the bottle and the bottle cap are connected and/or to depress the applicator head into the bottle cap by compressing the spring when the bottle and the bottle cap are connected.

4. The applicator of claim 2, the bottle cap further comprising:

an outer cap coupled to an inner cap, the inner cap coupled to the stem, the stem configured to move along a longitudinal axis within the inner cavity of the bottle cap.

5. The applicator of claim 4, the applicator head being coupled to the spring by the stem.

6. The applicator of claim 5, the spring being configured to provide enough force to allow the stem to extend the applicator head out of the bottle cap when the bottle cap is not connected to the bottle.

7. The applicator of claim 5, the spring being configured to allow the stem to retract the applicator head into the bottle cap when the bottle cap is connected to the bottle.

8. The applicator of claim 5, the stem being complimentary to the wiper such that only a predetermined amount of the stem enters the bottle when the bottle cap is connected to the bottle.

9. The applicator of claim 2, further comprising a first threaded rotational retention mechanism disposed around a circumference of a collar disposed on the bottle at a mouth of the product reservoir.

10. The applicator of claim 9, further comprising a second threaded rotational retention mechanism complementary to the first threaded rotational retention mechanism, the second threaded rotational retention mechanism disposed around a circumference of a collar disposed within the bottle cap at a mouth of the inner cavity.

11. The applicator of claim 2, further comprising a push-and-turn bayonet retention mechanism comprising a collar disposed around a circumference within the bottle cap at a mouth of the inner cavity and a complimentary member disposed around a circumference on the bottle at a mouth of the product reservoir.

12. The applicator of claim 1, the applicator head comprising a sponge applicator head, a foam applicator head, and/or a brush applicator head.

13. The applicator of claim 12, the applicator head further comprising a dovetail shape.

14. An applicator device for applying a product to a surface, the applicator device comprising:

a bottle for storing the product comprising a product reservoir and a wiper; and a bottle cap removably coupled to the bottle by a threaded rotational retention mechanism, the bottle cap comprising:

an automatically extending applicator head coupled to a stem, the stem configured to move along a longitudinal axis of the applicator device in contact with an inner cavity of the bottle cap;

a first spring coupled to the stem and an inner cap; and a second spring coupled to an inner channel of the stem, a portion of the stem enclosing a portion of the first spring, and the first and second springs are configured to provide a force for extending the stem and the automatically extending applicator head out of the bottle cap when the bottle cap is not connected to the bottle; and an outer cap for gripping during product application coupled to the inner cap.

15. The applicator device of claim 14, the wiper configured to depress the automatically extending applicator head into the bottle cap by compressing the spring when the bottle and the bottle cap are connected.

16. The applicator device of claim 15, the inner cavity of the bottle cap configured to allow the stem and the automatically extending applicator head to extend out of the bottle cap at least a predetermined length.

17. The applicator device of claim 16, the stem and the wiper are further configured to form a seal when the bottle cap and the bottle are connected.

18. The applicator device of claim 17, the automatically extending applicator head comprising a sponge applicator head, a foam applicator head, and/or a brush applicator head.

19. The applicator device of claim 14, the outer cap comprising a metal gripping surface or a plastic gripping surface.

20. An implement comprising:

a product bottle comprising a wiper;

an applicator head with a stem coupled to a spring, the stem comprising an upper portion and a middle portion, an inner surface of the middle portion of the stem circularly enclosing a section of the spring, the inner surface of the middle portion of the stem in contact with an exterior surface of the section of the spring, when the bottle cap is coupled to the bottle, the spring is compressed, a portion of the stem rests on the bottle causing the applicator head to be in contact with the wiper; and a bottle cap comprising an inner cap, the bottle cap removably coupled to the product bottle, an exterior surface of the upper portion of the stem configured to slide against the inner cap of the bottle cap, the bottle cap further coupled to the spring, the spring configured to extend the applicator head a predetermined length from the bottle cap when the bottle cap is removed from the product bottle.

* * * * *